US007207209B2

(12) United States Patent
Mitani et al.

(10) Patent No.: US 7,207,209 B2
(45) Date of Patent: Apr. 24, 2007

(54) FUEL EVAPORATION GAS LEAKAGE DETECTING SYSTEM AND METHOD OF DETECTING FUEL EVAPORATION GAS LEAKAGE

(75) Inventors: Tateki Mitani, Tokyo (JP); Toshihide Kimisawa, Yokohama (JP); Tsuyoshi Kato, Tokyo (JP)

(73) Assignees: Nifco Inc., Yokohama (JP); Mitsubishi Denki Kabushiki Kaisha, Tokyo (JP)

( * ) Notice: Subject to any disclaimer, the term of this patent is extended or adjusted under 35 U.S.C. 154(b) by 290 days.

(21) Appl. No.: 10/938,559

(22) Filed: Sep. 13, 2004

(65) Prior Publication Data

US 2005/0133097 A1 Jun. 23, 2005

(30) Foreign Application Priority Data

Dec. 19, 2003 (JP) ..... 2003-422488
Feb. 27, 2004 (JP) ..... 2004-053643

(51) Int. Cl.
*F02M 25/08* (2006.01)
*F02M 33/04* (2006.01)

(52) U.S. Cl. ..... 73/49.7; 123/516

(58) Field of Classification Search ..... 73/49.7; 126/516

See application file for complete search history.

(56) References Cited

U.S. PATENT DOCUMENTS 5,743,239 A * 4/1998 Iwase ..... 123/514
5,960,775 A * 10/1999 Tuckey ..... 123/509
6,626,156 B2 * 9/2003 Rosseel ..... 123/516
6,832,602 B2 * 12/2004 Tanimura ..... 123/509
6,964,268 B2 * 11/2005 Stickel ..... 123/516
2004/0200460 A1 * 10/2004 Mitani et al. ..... 123/520

FOREIGN PATENT DOCUMENTS

JP 2001-12319 1/2001

* cited by examiner

*Primary Examiner*—Michael Cygan
(74) *Attorney, Agent, or Firm*—Manabu Kanesaka

(57) ABSTRACT

A leak detecting system detects fuel gas leakage of a fuel tank. The detecting system includes a fuel pump, a jet pump, and a bent valve, which are disposed in the fuel tank. A fuel flow path system includes a relief line connected to the fuel pump for relieving an excess fuel, a relief flow path switching valve disposed in the relief line, and a sub-line for connecting the switching valve and the vent valve. An air flow path system includes a first air flow line to connect the vent valve to a canister, a second air flow line for connecting the first air flow line to the jet pump, and an air flow switching valve for switching communication between the first and second air flow lines. An inner pressure sensor is provided to the fuel tank for detecting an inner pressure of the fuel tank.

6 Claims, 7 Drawing Sheets

FUEL EVAPORATION GAS LEAKAGE DETECTING SYSTEM AND METHOD OF DETECTING FUEL EVAPORATION GAS LEAKAGE

BACKGROUND OF THE INVENTION AND RELATED ART STATEMENT

The present invention relates to a detecting system or device for detecting an unexpected leakage of fuel evaporation gas mainly from a fuel tank constituting an automobile fuel supply device, and a method of detecting gas leakage by using the device.

Japanese Patent Publication (Kokai) No. 2001-12319 has disclosed a device for detecting leakage of fuel evaporation gas in a fuel tank constituting an automobile fuel supply device, i.e. a device for diagnosing leakage.

The device disclosed in Japanese Patent Publication (Kokai) No. 2001-12319 includes an air pump, a driving motor and surrounding pipes, thereby making the device complicated. In the device, the leakage is detected through an operation voltage of the driving motor of the air pump, thereby making it difficult to accurately detect the leakage. Further, it is necessary to start the air pump for detecting the leakage after an internal combustion engine is stopped, thereby wasting a battery and generating operation noise of the air pump after the internal combustion engine is stopped.

In view of the problems described above, an object of the present invention is to provide a device with a simple structure for precisely detecting an unexpected leakage of the fuel evaporation gas from the fuel tank.

Further objects and advantages of the invention will be apparent from the following description of the invention.

SUMMARY OF THE INVENTION

In order to attain the objects described above, according to the present invention, a detecting system or device for detecting leakage of fuel evaporation gas in an automobile fuel supply device includes, as a fuel flow path system, (1) a relief line for relieving a part of fuel sucked by a fuel pump as excess fuel;

(2) a jet pump disposed in the relief line;

(3) a relief flow path switching valve disposed in the relief line at a downstream side of the jet pump; and (4) a sub-line connecting between the relief flow path switching valve and a vent valve;

as an air flow path system, (5) a first air flow line connecting the vent valve and a canister;

(6) a second air flow line connecting the first air flow line and the jet pump; and (7) an air flow switching valve for selectively switching between a communicating state and non-communicating state between the first air flow line and the second air flow line; and (8) an inner pressure sensor provided to a fuel tank.

According to the present invention, the detecting device is constructed such that when the air flow switching valve switches to the communicating state, air is brought in the fuel tank through the first air flow line and the second air flow line with the excess fuel brought in the jet pump. The vent valve includes a fuel receiving tank communicating with the first air flow line and the sub-line; a float valve member disposed in the receiving tank for floating to block a communicating portion between the receiving tank and the first air flow line from a side of the receiving tank when fuel flows in the receiving tank; and an outflow portion for gradually discharging fuel in the fuel receiving tank to outside.

When the gas leakage is detected, the relief flow-path switching valve is operated to supply the excess fuel to the receiving tank of the vent valve. The outflow portion provided in the receiving tank is structured such that fuel in the receiving tank flows outside gradually. Accordingly, the float valve member is floated by the excess fuel to thereby block the communicating portion. At the same time, the air flow switching valve is operated to communicate the first air flow line with the second air flow line, and air is forcibly sent to the fuel tank by the jet pump. Then, the airflow switching valve is operated to block the communicating state between the first air flow line and the second air flow line. In this state, the inner pressure sensor detects the inner pressure of the fuel tank increased by the air forcibly sent therein. If the inner pressure is dropped quickly, it is determined that an unexpected gas leakage occurs.

In the detecting device described above, the first air flow line connecting the vent valve and the canister is utilized to forcibly send air in the fuel tank for detecting the gas leakage. Accordingly, it is not necessary to separately provide an air flow path for sending air in the fuel tank, so that a mechanism for detecting gas leakage can be appropriately provided to the fuel tank without impairing reliability of the fuel tank.

According to the present invention, the jet pump may include a discharge nozzle for the excess fuel disposed in a chamber connected to the second air flow line, and a discharge port formed at a front portion of the discharge nozzle in the chamber. A ratio of an inner diameter of the discharge nozzle to an inner diameter of the discharge port may be in a range between 1 to 3.5 and 1 to 5. When the ratio of the inner diameter of the discharge nozzle to the inner diameter of the discharge port is in the range, it is possible to effectively increase the inner pressure of the fuel tank in a short period of time.

According to the present invention, a method of detecting fuel evaporation gas leakage uses the fuel evaporation gas leakage detecting device described above in the automobile fuel supply system. The method includes the following (1)–(5) steps:

(1) supplying the excess fuel to the receiving tank of the vent valve through the sub-line by operating the relief flow path switching valve, and blocking a communicating portion between the receiving tank and the first air flow line by floating the float valve member;

(2) forcibly sending air in the fuel tank through the first air flow line and the second air flow line by the excess fuel flowing in the jet pump while the first air flow line communicates with the second air flow line by operating the air flow switching valve to increase an internal pressure of the fuel tank to a predetermined pressure;

(3) detecting the inner pressure with the inner pressure sensor under a non-communicating state between the first air flow line and the second air flow line by switching the air flow switching valve; and (4) comparing the detected inner pressure with the inner pressure determined beforehand under a normal state without leakage of the fuel evaporation gas.

In the invention, the excess fuel is sent in the receiving tank of the vent valve through the operation of the relief flow path switching valve, so that the float valve member is floated to block the communicating portion. Then, the air flow switching valve is operated to communicate the first air flow line with the second air flow line, and air is forcibly sent to the fuel tank by the jet pump. Thereafter, the air flow switching valve is operated to return to the non-communicating state of the first air flow line and the second air flow line, so that the inner pressure of the fuel tank is held at an increased pressure. In this state, the inner pressure sensor detects the inner pressure of the fuel tank to be compared with an inner pressure under the normal condition, so that the unexpected gas leakage of the fuel tank is precisely detected.

Such a detecting method is preferably carried out when an automobile starts idling. In other words, when the automobile becomes an idling state, the excess fuel is supplied to the receiving tank of the vent valve to forcibly send air in the fuel tank.

When the automobile is running, fuel in the fuel tank swings and the inner pressure of the fuel tank tends to be unstable. Due to vibrations, the float valve member constituting the vent valve also tends to be unstable in blocking the communicating portion. Further, when the automobile is running, the internal combustion engine uses a larger quantity of fuel, thereby reducing the excess fuel to be sent to the jet pump. Accordingly, the leak detection is preferably limited only when the automobile is idling, thereby accurately detecting the leakage without the problems described above.

In the fuel evaporation gas leak detecting device in the automobile fuel supply device of the present invention, it is possible to detect the unexpected gas leakage from the fuel tank constituting the fuel supply device with the simple structure. In the method of detecting the fuel evaporation gas leakage, it is possible to precisely detect the unexpected gas leakage by using the device.

DETAILED DESCRIPTION OF PREFERRED EMBODIMENT

Figure 1:
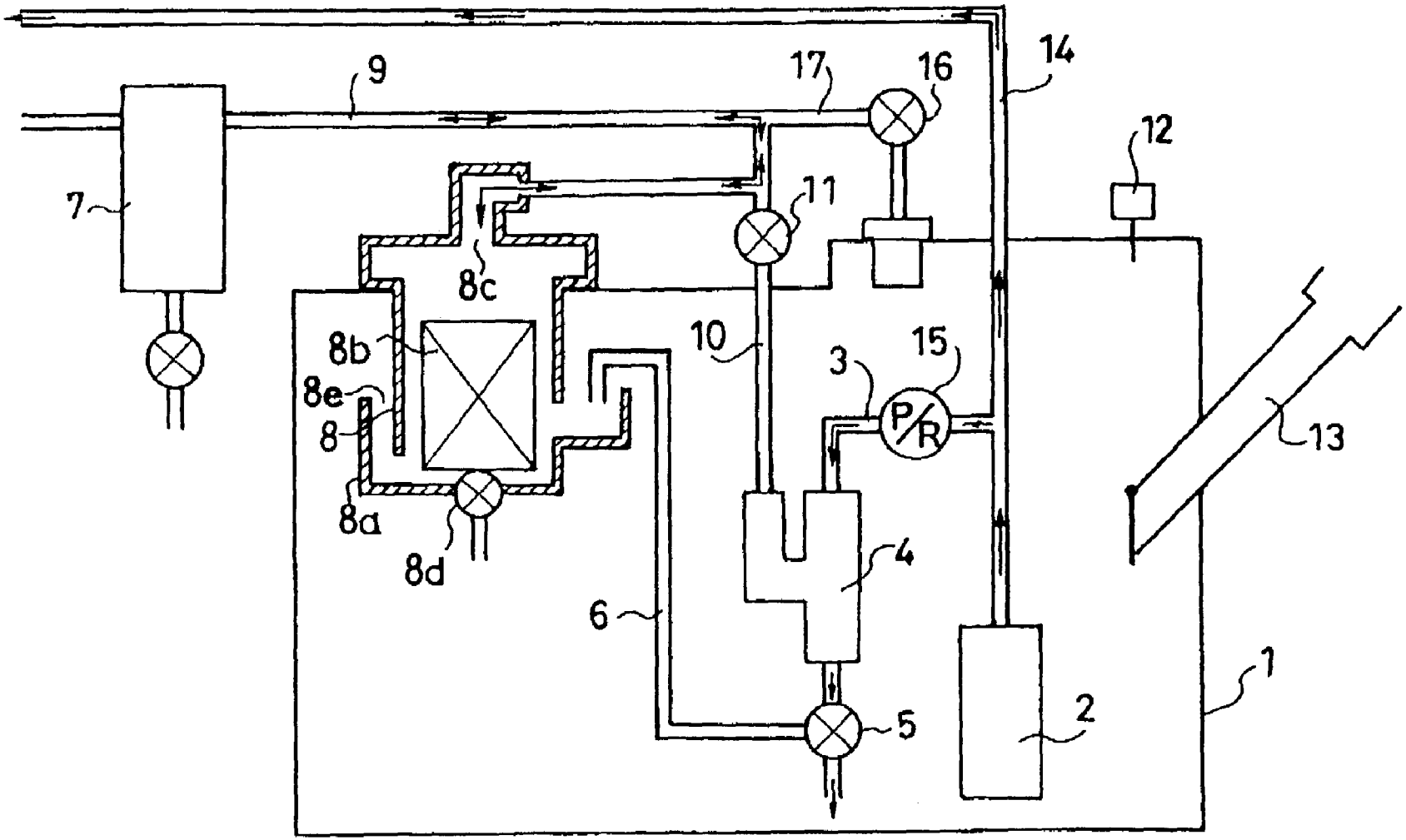
FIG. 1 is a view showing an automobile fuel supply device with a detecting device according to an embodiment of the present invention.
Figure 2:
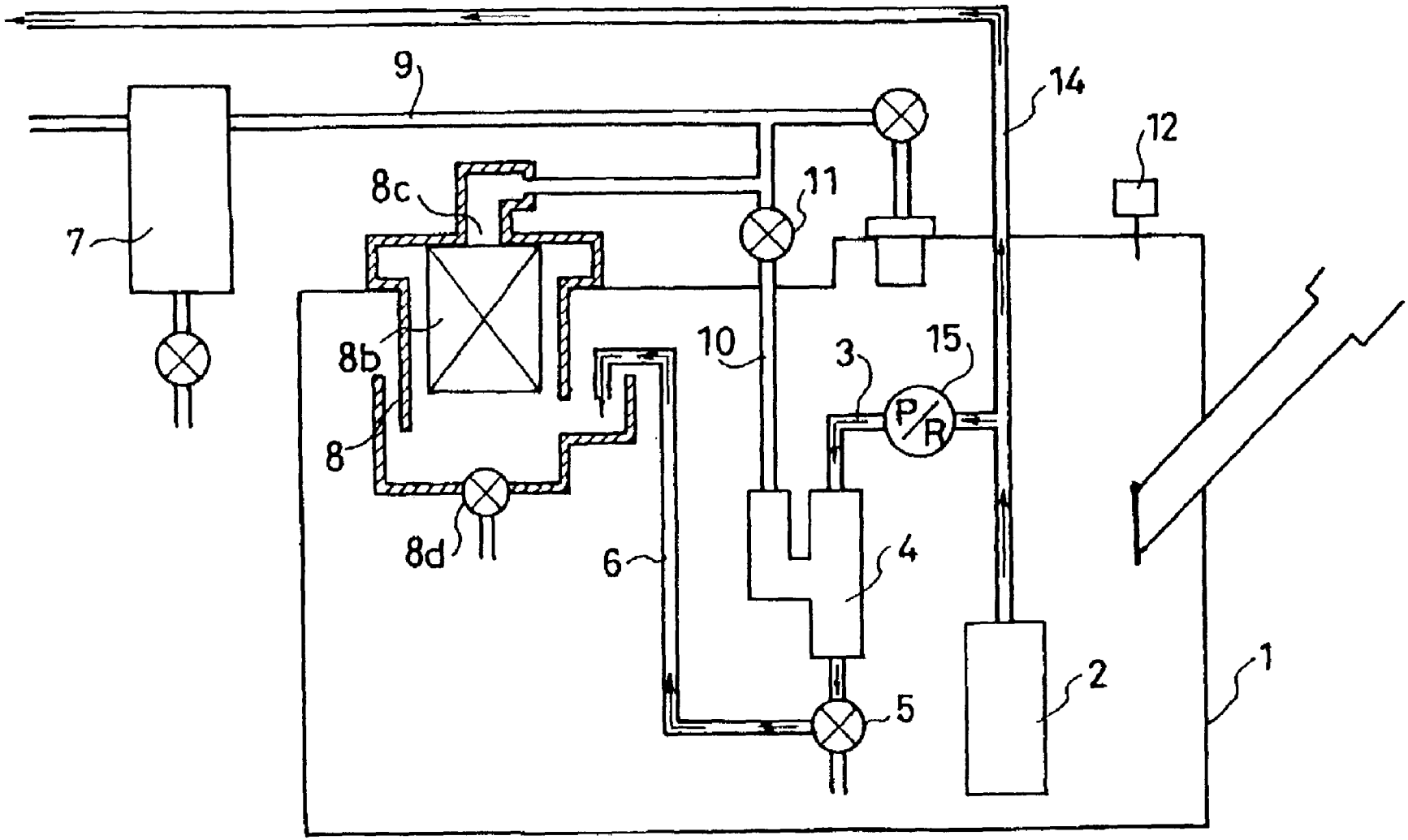
FIG. 2 is a view showing the automobile fuel supply device with the detecting device.
Figure 3:
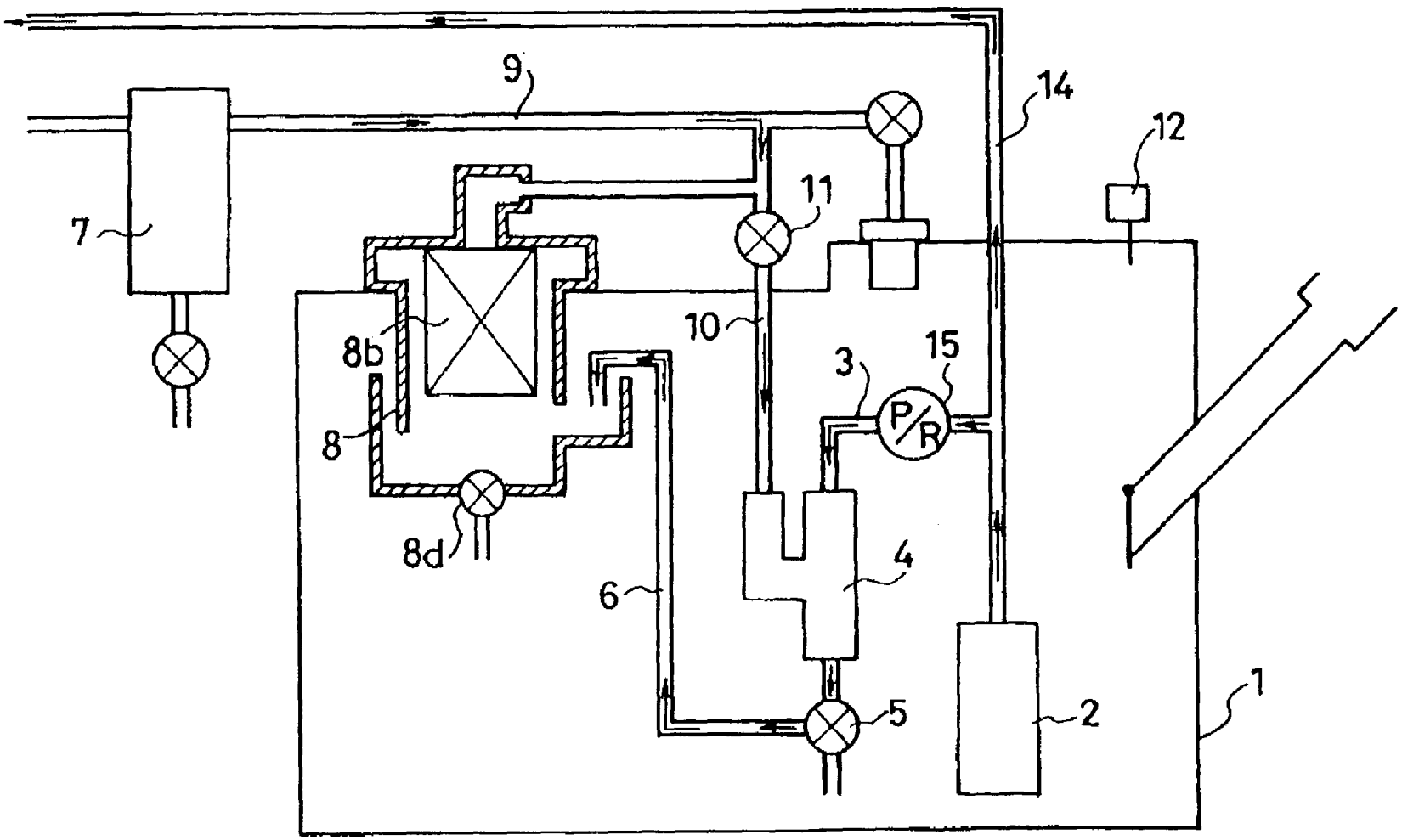
FIG. 3 is a view showing the automobile fuel supply device with the detecting device.
Figure 4:
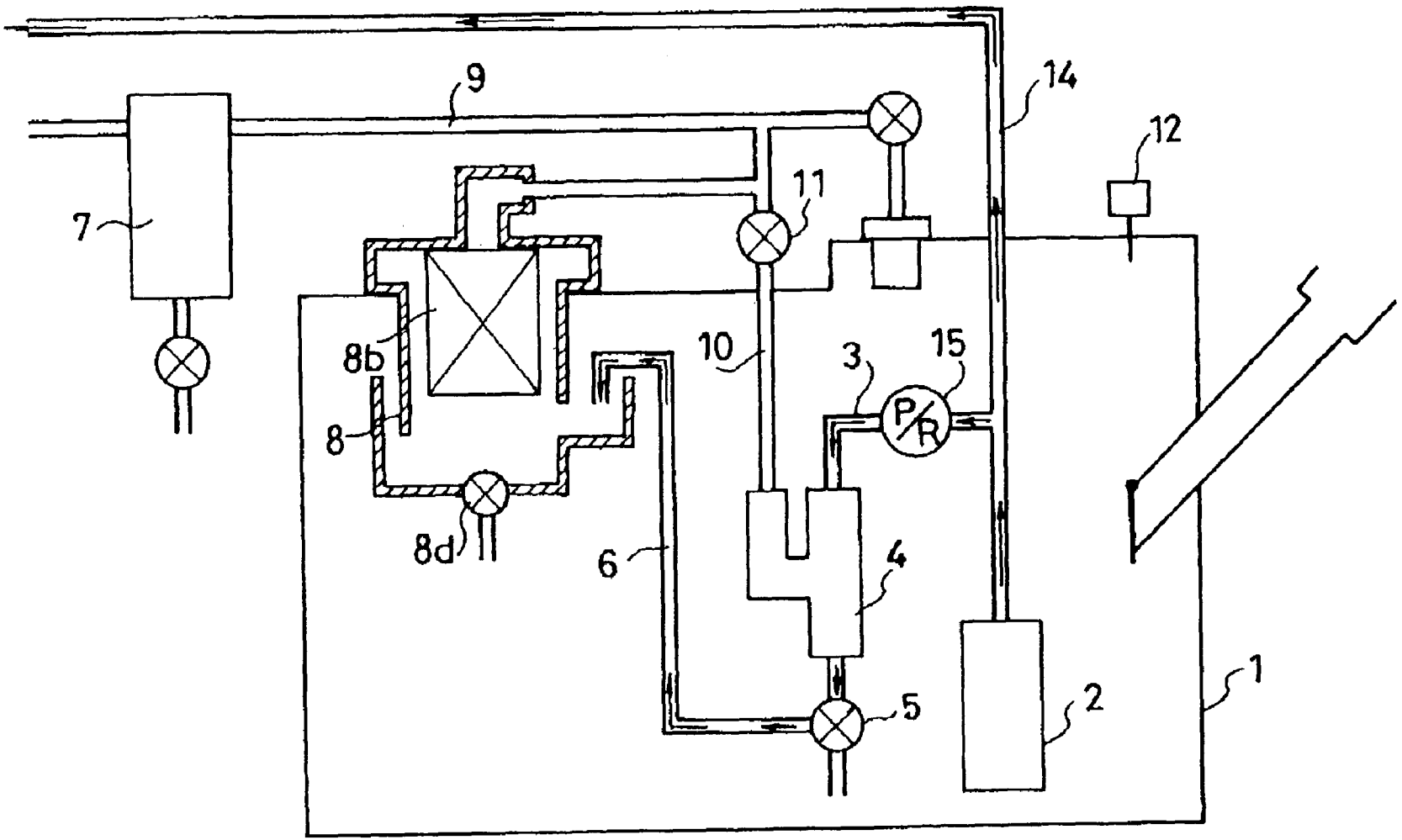
FIG. 4 is a view showing the automobile fuel supply device with the detecting device.

Hereunder, embodiments of the present invention will be explained with reference to the accompanying drawings. FIGS. 1 to 4 are views showing an automobile fuel supply device with a detecting device according to an embodiment of the present invention. FIG. 1 shows a normal state before an operation of detecting a gas leakage; and FIGS. 2 to 4 show processes of the detecting operation. Arrows in the drawings show flows of fuel gas and air, and liquid fuel is not shown in the drawings.

According to the present embodiment, a device for detecting fuel evaporation gas leakage in an automobile fuel supply device detects an unexpected leakage of gas mainly from a fuel tank 1 constituting a fuel supply device with a simple structure. A method of detecting the fuel evaporation gas leakage precisely determines whether gas is leaking or not by using the device.

The leakage detecting device includes a fuel flow system having:

(1) a relief line 3 for relieving a portion of fuel sucked by a fuel pump 2 as excess fuel;

(2) a jet pump 4 disposed in the relief line 3;

(3) a relief flow-path switching valve 5 disposed in the relief line 3 at a downstream side of the jet pump 4; and (4) a sub-line 6 connecting between the relief flow-path switching valve 5 and a vent valve 8.

The leakage detecting device also includes an air flow path system having:

(1) a first air flow line 9 connecting between the vent valve 8 and a canister 7;

(2) a second air flow line 10 connecting between the first air flow line 9 and the jet pump 4; and (3) an air flow switching valve 11 for switching between a communicating state and non-communicating state between the first air flow line 9 and the second air flow line 10.

An inner pressure sensor 12 is provided for detecting an inner pressure of the fuel tank 1. In the embodiment shown in the drawings, the fuel pump 2 disposed in the fuel tank 1 is activated to supply fuel to an internal combustion engine, specifically, a gasoline injector, via a main fuel line 14 from the fuel tank 1 storing fuel supplied through a hose 13. The relief line 3 is a flow path for relieving a part of fuel in the fuel tank 1 sucked by the fuel pump 2 as the excess fuel with a pressure controlled by a pressure regulator 15.

A third air flow line 17 provided with a check valve 16 is connected to the first air flow line 9. After the excess fuel is supplied to the receiving tank 8*a* constituting the vent valve 8 and the float valve member 8*b* is floated to block the vent valve 8, the jet pump 4 forcibly sends air to the fuel tank 1 to increase an inner pressure of the fuel tank 1 to open the check valve 16 for detecting the gas leakage (described later). The jet pump 4 is structured to send air to the fuel tank 1 through the first air flow line 9 and the second air flow line 10 in the communicating state by the air flow switching valve 11 by the excess fuel brought in the jet pump 4.

The vent valve 8 includes:

(1) the fuel receiving tank 8*a* communicating with the first air flow line 9 and the sub-line 6;

(2) the float valve member 8*b* disposed in the receiving tank 8*a* for blocking a communicating portion 8*c* between the receiving tank 8*a* and the first air flow line 9 from a side of the receiving tank 8*a* by floating when fuel flows in the receiving tank 8*a*; and (3) an outflow portion 8*d* for gradually discharging fuel in the fuel receiving tank 8*a* to outside.

In the embodiment, the first air flow line 9 is connected to an upper portion of the receiving tank 8*a*. The sub-line 6 is connected to a side portion of the receiving tank 8*a*. The outflow portion 8*d* is disposed at a bottom of the receiving tank 8*a*. The receiving tank 8*a* is provided with an opening portion 8*e*, so that air in the fuel tank 1 is sent out to a canister 7 through the opening portion 8*e* when fuel is supplied to the fuel tank 1. When a level of fuel is increased, i.e. filling up the fuel tank 1 with fuel, the float valve member 8*b* is floated by fuel fed in the receiving tank 8*a* through the opening portion 8*e* to thereby block the communicating portion 8*c*.

The outflow portion 8*d* may be a small hole passing through a bottom portion of the receiving tank 8*a*, or a one way valve for passing fuel only from the receiving tank 8*a* and not from the fuel tank 1 to the receiving tank 8*a*. The outflow portion 8*d* gradually discharges fuel in the receiving portion to the fuel tank 1. Accordingly, the float valve member 8*b* is floated to a position for blocking the communicating portion 8*c* by fuel, and is lowered after a certain period of time, so that the fuel tank 1 communicates with the canister 7 through the communicating portion 8*c*.

Normally, the excess fuel relieved through the jet pump 4 flows back to the fuel tank 1. The first air flow line 9 and the second air flow line 10 become a non-communicating state (FIG. 1). When the gas leakage is detected, first, the relief flow-path switching valve 5 is operated to supply the excess fuel to the receiving tank 8*a* of the vent valve 8 (FIG. 2). The outflow portion 8*d* is provided in the receiving tank 8*a* for gradually passing fuel in the receiving tank 8*a* to outside. Accordingly, the float valve member 8*b* is floated by the excess fuel fed as described above to thereby block the communicating portion 8*c*. Specifically, the excess fuel flows from the sub-line 6 in an amount larger than that of fuel passing through the outflow portion 8*d*.

At the same time, the air flow switching valve 11 is operated to communicate the first air flow line 9 with the second air flow line 10, and air is forcibly sent to the fuel tank 1 by the action of the jet pump 4 (FIG. 3). Thereafter, the airflow switching valve 11 is operated again, so that the first air flow line 9 and the second air flow line 10 are returned to a non-communicating state (FIG. 4). In this state, the inner pressure sensor 12 detects the inner pressure of the fuel tank 1 increased by air forcibly sent therein. When the inner pressure increased as described above is quickly lowered, it is determined that the unexpected gas leakage occurs.

The excess fuel fed into the receiving tank 8*a* of the vent valve 8 gradually flows to outside through the outflow portion 8*d*. Accordingly, after the leakage is detected, when the relief flow path switching valve 5 is operated again so that the excess fuel is not sent to the sub-line 6, the fuel level of the receiving tank 8*a* decreases to lower the float valve member 8*b*, and the fuel tank 1 and the canister 7 are returned to the communicating state through the vent valve 8 (FIG. 1).

Figure 5:
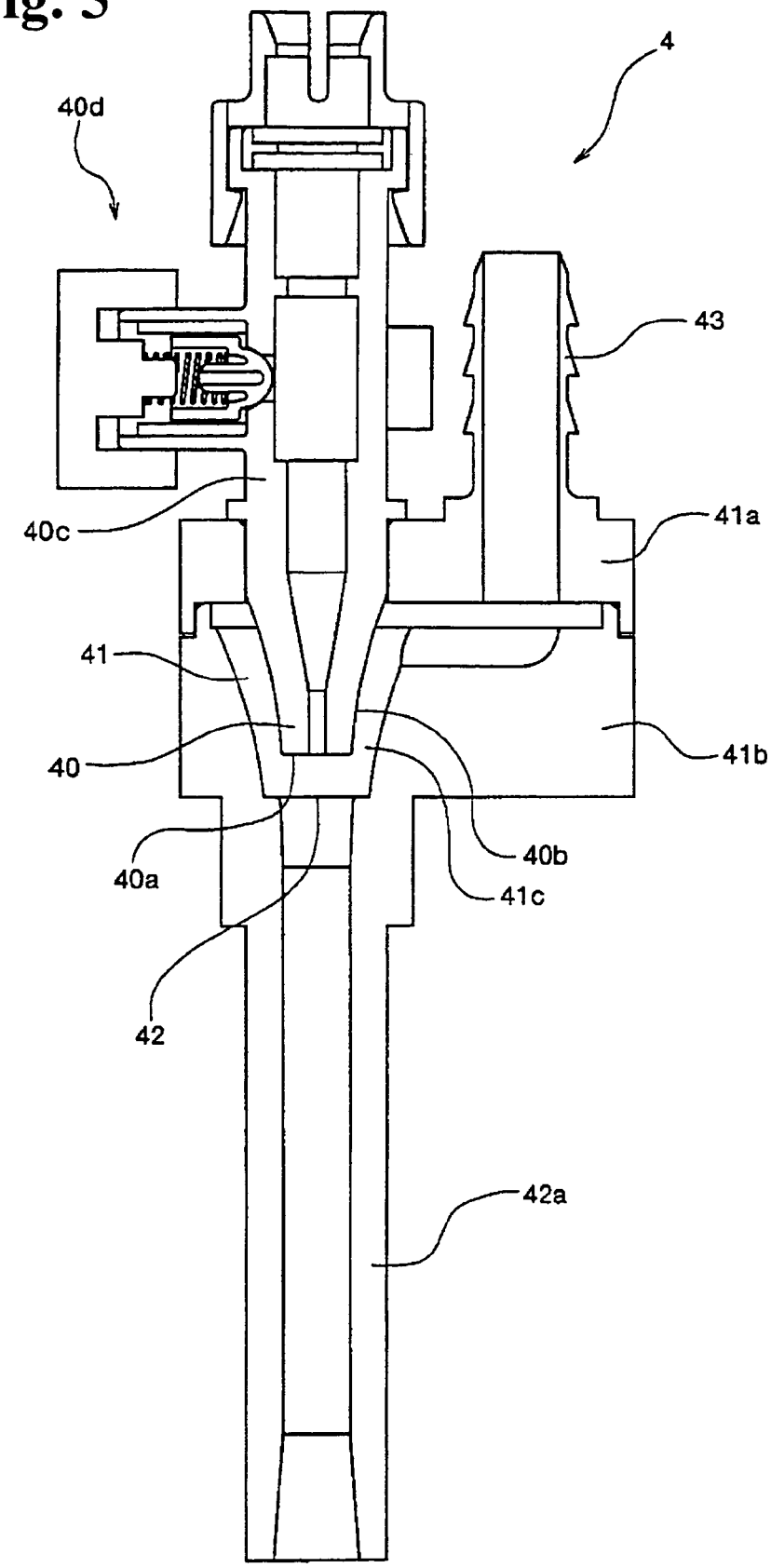
FIG. 5 is a sectional view showing a jet pump of the detecting device.

The jet pump 4 constituting the detecting device may have a structure shown in FIG. 5. The jet pump includes:

(1) a discharge nozzle 40 disposed in a chamber 41 connected to the second air flow line 10 for jetting the excess fuel; and (2) a discharge port 42 formed at a forward portion of the discharge nozzle 40 in the chamber 41, wherein (3) a ratio of an inner diameter of the discharge nozzle 41 to an inner diameter of the discharge port 42 is in a range between 1 to 3.5 and 1 to 5.

In the embodiment shown in the drawings, the discharge nozzle 40 is integrally provided to an upper member 41*a* of the chamber 41 and projects downwardly from an inner wall of the upper member 41*a*. The discharge nozzle 40 is formed in a shape tapered toward a tail end 4*a*, and has an outer surface 40*b* as a tapered surface along an outer surface of a virtual cone and an inner diameter decreasing toward the tail end 40*a*.

The discharge port 42 is formed in an inner wall of a lower member 41*b* of the chamber 41. In the embodiment, an upper end of the discharge pipe 42*a* is integrally connected to the lower member 41*b* of the chamber 41 to form the discharge port 42. The discharge port 42 is provided to a bottom portion of a cone-shape concave portion 41*c* with a diameter gradually decreasing toward an opening edge of the discharge port 42. The tail end 40*a* of the discharge nozzle 40 is inserted into the concave portion 41*c* with a space between the outer surface of the discharge nozzle 40 and a wall surface of the concave portion 41*c*.

When the excess fuel is jetted out from the discharge nozzle 40, a negative pressure is effectively generated between the discharge nozzle 40 and the concave portion 41*c*. Accordingly, air is brought into the chamber 41 from the second air flow line 10 by the negative pressure, and air is sent to outside of the chamber 41 through the discharge port 42 together with the excess fuel.

As shown in FIG. 5, an sucking pipe 43 is connected to an inner wall of the upper member 41*a* of the chamber 41 so that a lower end of the sucking pipe 43 communicates with the chamber 41. The sucking pipe 43 is also connected to the second air flow line 10. The discharge nozzle 40 is formed at the lower end of the tube member 40*c* integrally assembled to the upper member 41*a*. The excess fuel is fed from an upper end side of the tube member 40*c*, and a relief valve 40*d* is disposed at an intermediate portion of the tube end 40*c*, thereby preventing an excess back pressure at an upstream side of the relief line 3.

When a ratio of the inner diameter of the discharge nozzle 40 (inner diameter of the tail end 40*a* of the discharge nozzle 40) to the inner diameter of the discharge port 42 is in a range between approximately 1 to 3.5 and 1 to 5, the inner pressure of the fuel tank 1 is effectively increased in a short period of time.

Figure 6:
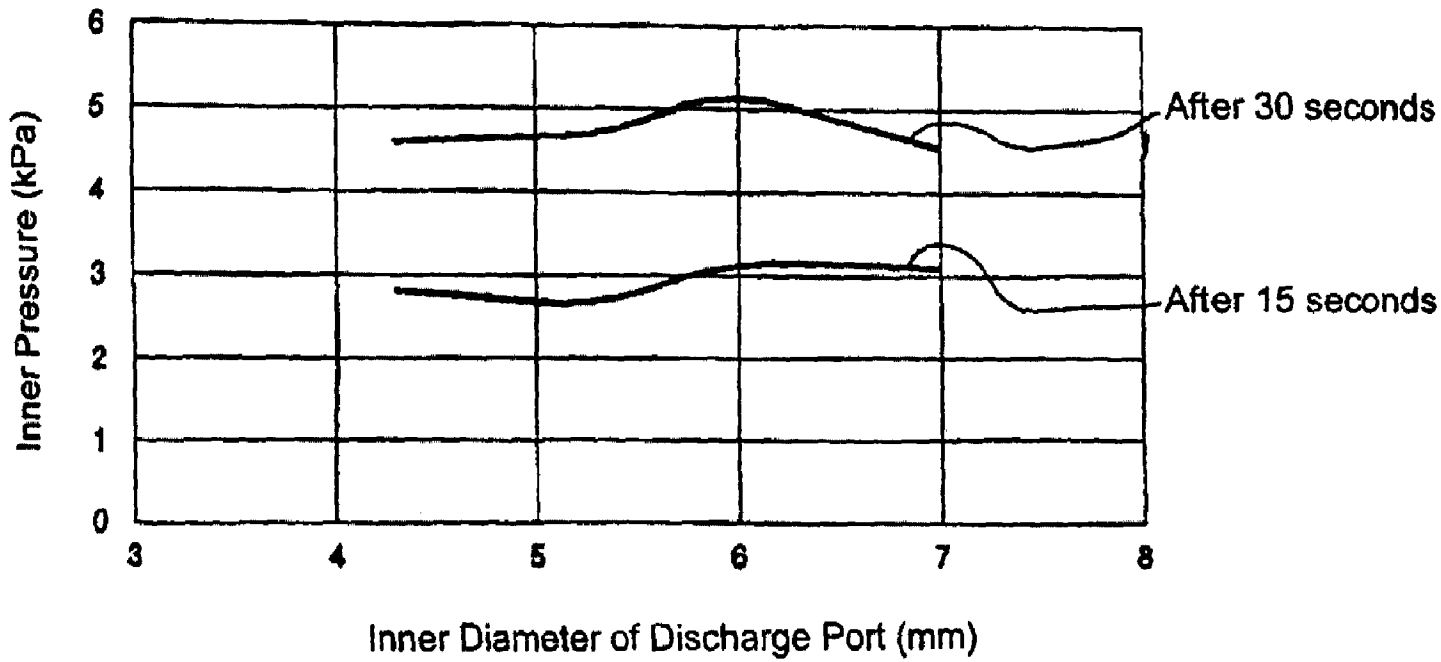
FIGS. 6 and 7 are graphs showing results of experiments.

In an experiment, the excess fuel was discharged from the discharge nozzle 40 at 100 l/h, the inner diameter of the discharge nozzle 40 was 1.3 mm, and the inner diameter of the discharge port 42 was varied in a range of 4.3 mm to 7 mm. While air was brought in through the second air flow line, the inner pressure of the fuel tank 1 was measured after 15 seconds and 30 seconds, respectively, after air was brought in. The results are shown in FIG. 6.

It was confirmed that the inner pressure of the fuel tank was effectively increased in a short period of time when the inner diameter of the discharge port 42 was in a range of 4.5 mm to 6.5 mm, i.e. the ratio of the inner diameter of the discharge nozzle 40 to the inner diameter of the discharge port 42 between approximately 1 to 3.5 and 1 to 5.

Figure 7:
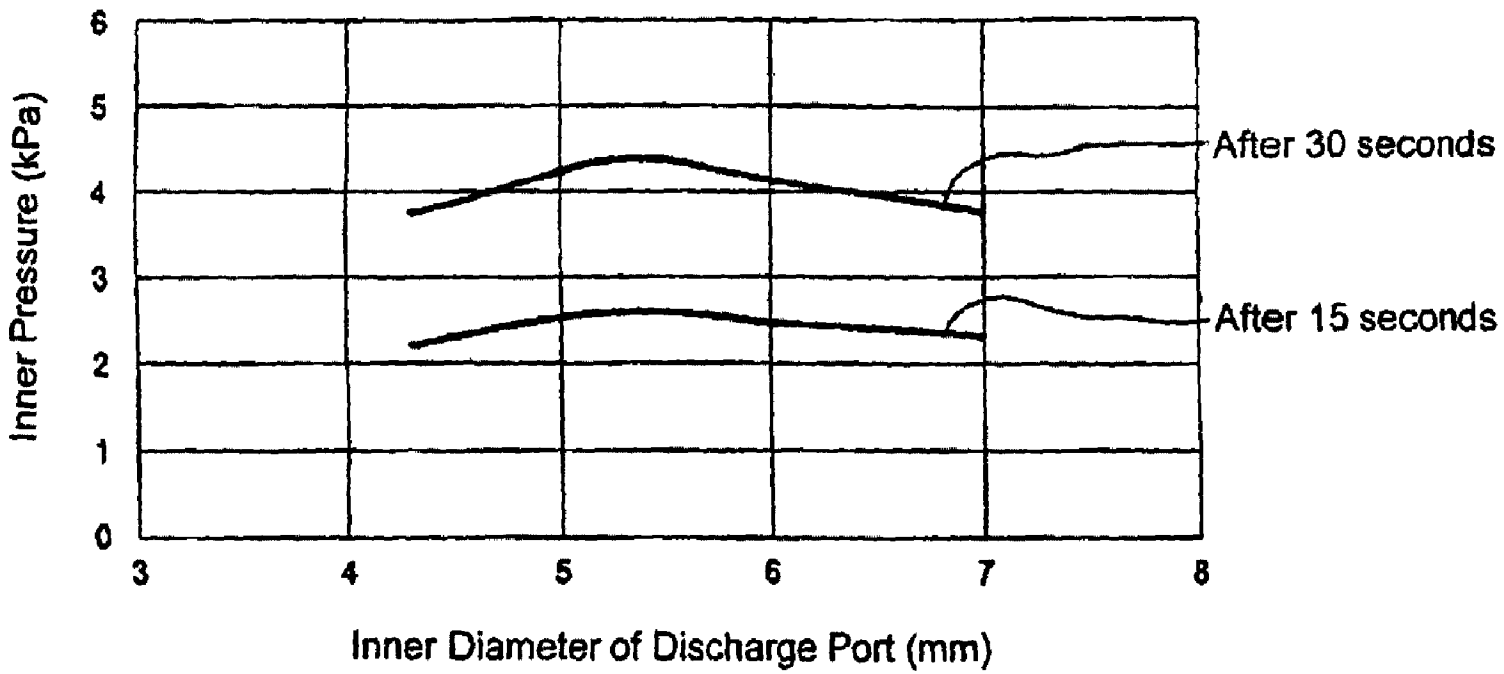

In another experiment, the excess fuel was discharged from the discharge nozzle 40 at 80 l/h, the inner diameter of the discharge nozzle 40 was 1.3 mm, and the inner diameter of the discharge port 42 was in a range of 4.3 mm to 7 mm. While air was brought in through the second air flow line, the inner pressure of the fuel tank 1 was measured after 15 seconds and 30 seconds, respectively, after air was brought in. The results are shown in FIG. 7.

In this experiment, it was also confirmed that the inner pressure on a side of the fuel tank was effectively increased in a short period of time when the inner diameter of the discharge port 42 was in a range of 4.5 mm to 6.5 mm, i.e. the ratio of the inner diameter of the discharge nozzle 40 to the inner diameter of the discharge port 42 between approximately 1 to 3.5 and 1 to 5.

According to the present embodiment, a method of detecting the leakage detects the fuel evaporation gas leakage on a side of the fuel tank 1 by using the leak detecting device described above.

The detecting method includes:

(1) operating the relief flow path switching valve 5 to supply the excess fuel to the receiving tank 8*a* of the vent valve 8 through the sub-line 6, so that the float valve member 8*b* is floated to block the communicating portion 8*c* between the receiving tank 8*a* and the first air flow line 9;

(2) operating the air flow switching valve 11 to communicate the first air flow line 9 with the second air flow line 10, and forcibly sending air to the fuel tank 1 through the first air flow line 9 and the second air flow line 10 by the excess fuel brought in the jet pump 4 to increase the internal pressure of the fuel tank 1 to a predetermined pressure;

(3) detecting the inner pressure with the inner pressure sensor 12 under the non-communicating state between the first air flow line 9 and the second air flow line 10 by switching the air flow switching valve 11; and (4) comparing the-detected inner pressure with an inner pressure data (hereinafter referred to as "reference data") determined beforehand under the normal state where the unexpected leakage of the fuel evaporation gas does not take place.

The relief flow path switching valve 5 is operated to supply the excess fuel to the receiving tank 8*a* of the vent valve 8, so that the float valve member 8*b* is floated to block the communicating portion 8*c* (FIG. 2). At the same time, the air flow switching valve 11 is operated to communicate the first air flow line 9 with the second air flow line 10, and the jet pump 4 forcibly sends air to the fuel tank 1 to pressurize the fuel tank 1. Thereafter, the air flow switching valve 11 is operated again to return to the non-communicating state of the first air flow line 9 and the second air flow line 10, and the inner pressure on the side of the fuel tank 1 is held at an increased constant pressure (FIG. 4).

In this state, the inner pressure sensor 12 detects the inner pressure data on the side of the fuel tank 1 and the detected inner pressure is compared with the reference data, so that the unexpected gas leakage from the side of the fuel tank 1 can be precisely detected and determined. The detection and determination can be carried out by using a microcomputer and an electronic circuit. In a case that the unexpected leakage is detected, the leakage is notified to a driver.

The leakage detection is preferably carried out when an automobile starts idling. In other words, when the automobile becomes an idling state, the excess fuel is supplied to the receiving tank 8*a* of the vent valve 8 to forcibly send air in the fuel tank 1.

When the automobile is running, fuel in the fuel tank 1 swings and the inner pressure of the fuel tank 1 tends to be unstable. Due to vibrations, the float valve member 8*b* constituting the vent valve 8 also tends to be unstable in blocking the communicating portion 8*c*. Further, when the automobile is running, the internal combustion engine uses a larger quantity of fuel, thereby reducing the excess fuel to be sent to the jet pump 4. Accordingly, the leak detection is preferably limited only when the automobile is idling, thereby accurately detecting the leakage without the problems described above.

The disclosures of Japanese Patent Applications No. 2003-422488 filed on Dec. 19, 2003 and No. 2004-053643 have been incorporated in the application.

While the invention has been explained with reference to the specific embodiments of the invention, the explanation is illustrative and the invention is limited only by the appended claims.

What is claimed is:

1. A leak detecting system for detecting fuel evaporation gas leakage of an automobile fuel supply device, comprising:

a fuel pump, a jet pump, and a vent valve, which are disposed in a fuel tank, a fuel flow path system including a relief line connected to the fuel pump for relieving a portion of fuel sucked by the fuel pump as excess fuel, said jet pump being disposed in the relief line; a relief flow path switching valve disposed in the relief line on a downstream side of the jet pump; and a sub-line for connecting the relief flow path switching valve and the vent valve, an air flow path system including a first air flow line adapted to connect the vent valve to a canister; a second air flow line for connecting the first air flow line to the jet pump; and an air flow switching valve disposed in the second air flow line for switching a communicating state and a non-communicating state between the first air flow line and the second air flow line so that the jet pump operated by the excess fuel sucks air into the fuel tank through the first air flow line and the second air flow line in the communicating state, and an inner pressure sensor provided to the fuel tank for detecting an inner pressure of the fuel tank so that a leakage condition in the fuel tank when air is supplied into the fuel tank is detected.

2. A leakage detecting system according to claim 1, wherein said vent valve includes a fuel receiving tank connected to the first air flow line and the sub-line, a float valve member disposed in the receiving tank for blocking a communicating portion of the receiving tank by floating when fuel flows in the receiving tank, and an outflow portion for allowing the fuel in the fuel receiving tank to gradually flow outside.

3. A leak detecting system according to claim 1, wherein said jet pump includes a discharge nozzle disposed in a chamber connected to the second air flow line, and a discharge port formed at a forward portion of the discharge nozzle, a ratio of an inner diameter of the discharge nozzle to an inner diameter of the discharge port being approximately in a range between 1 to 3.5 and 1 to 5.

4. A leak detecting system according to claim 1, further comprising a pressure regulator disposed in the relief line for regulating an amount of the fuel flowing into the relief line.

5. A method of detecting fuel evaporation gas leakage using the detecting system according to claim 2, comprising:

operating the relief flow path switching valve to supply the excess fuel to the receiving tank of the vent valve through the sub-line so that the float valve member is floated to block a communicating portion between the receiving tank and the first air flow line, operating the air flow switching valve to communicate the first air flow line with the second air flow line, sucking air forcibly to the fuel tank through the first air flow line and the second air flow line by the jet pump to increase an internal pressure of the fuel tank to a predetermined pressure, operating the air flow switching valve to block a communicating, state between the first air flow line and the second air flow line, detecting the inner pressure with the inner pressure sensor, and comparing the inner pressure with an inner pressure determined beforehand under a state without leakage.

6. A method of detecting fuel evaporation gas leakage according to claim 5, wherein the step of operating the relief flow path switching valve to supply the excess fuel to the receiving tank of the vent valve is started in an idling state of an engine.

* * * * *